United States Patent [19]

Michaux

[11] Patent Number: 4,637,241

[45] Date of Patent: Jan. 20, 1987

[54] FULLY UNIVERSAL ROLLING PROCESS FOR H OR I-BEAM TYPE METAL SECTIONS

[75] Inventor: Jacques M. Michaux, Joeuf, France

[73] Assignee: Sacilor, Hayange, France

[21] Appl. No.: 591,865

[22] Filed: Mar. 21, 1984

[30] Foreign Application Priority Data

Mar. 21, 1983 [FR] France ..... 83 04589

[51] Int. Cl.[4] ..... B21B 1/10; B21B 1/14

[52] U.S. Cl. ..... 72/225; 72/289; 72/234; 72/366

[58] Field of Search ..... 72/225, 234, 235, 226, 72/229, 366, 221

[56] References Cited

U.S. PATENT DOCUMENTS

| | | | |
|---|---|---|---|
| 410,107 | 8/1889 | Kennedy et al. | 72/225 |
| 1,002,907 | 9/1911 | Dunn | 72/235 X |
| 1,546,025 | 7/1925 | Rendleman | 72/234 |
| 3,583,193 | 6/1971 | Kishikawa | 72/225 |
| 4,086,801 | 5/1978 | Nakajima et al. | 72/234 |
| 4,294,094 | 10/1981 | Okado et al. | 72/234 X |
| 4,402,206 | 9/1983 | Yanazawa et al. | 72/366 X |

FOREIGN PATENT DOCUMENTS

| | | | |
|---|---|---|---|
| 744683 | 1/1944 | Fed. Rep. of Germany . | |
| 2346063 | 3/1977 | France . | |
| 2464759 | 9/1980 | France . | |
| 174160 | 10/1965 | U.S.S.R. . | |
| 0623593 | 9/1978 | U.S.S.R. | 72/225 |
| 816583 | 3/1981 | U.S.S.R. | 72/225 |

OTHER PUBLICATIONS

Patent Abstracts of Japan, vol. 4, No. 105, No. 55-64905, Iron and Steel Engineer, May, 1970, pp. 73-76.

*Primary Examiner*—Francis S. Husar
*Assistant Examiner*—Steve Katz
*Attorney, Agent, or Firm*—Stiefel, Gross, Kurland & Pavane

[57] ABSTRACT

A rough beam (4) is formed on a universal stand (11), and a two high stand starting with an initial section (1) of rectangular or trapezoidal cross-section, in two series of passes in the universal stand. During the first series reduction of the web forming portion is effected by horizontal rolls (5, 6) acting on the central portion of the initial section (1) and during the second series of passes both the horizontal rolls (5, 6) and the vertical rolls (7, 8) of the universal stand (11) simultaneously reduce the web and flanges, respectively. The rough-beam being formed during the second series of passes is also rolled in the open grooves of a two high stand.

17 Claims, 31 Drawing Figures

FULLY UNIVERSAL ROLLING PROCESS FOR H OR I-BEAM TYPE METAL SECTIONS

TECHNICAL FIELD

This invention relates to a fully universal rolling process for H or I-beam steel sections.

BACKGROUND ART

The process known as universal beam rolling starts with an initial section (1) of rectangular cross section (FIG. 1) and is characterized by having two distinct steps. In the first non-universal step, the initial section (1) is rolled in one or more two-high stands (called the "breakdown" mill) through a plurality of passes made in closed or open grooves which convert the initial section into a partially manufactured section (2) called the "dogbone" (FIG. 1). In the second universal step, the dogbone (2) is rolled through a plurality of passes in open edging and universal grooves which convert it into a finished H or I-beam section (3) (FIG. 1). See *Iron and Steel Engineer,* May, 1970, page 76.

The process described above has two major disadvantages. The first of these is the necessity of forming the dogbone (2), during the first step, in closed grooves and to turn-over the bar through 90° during the rolling. This disadvantage considerably reduces the rolling speed and causes high wear and tear on the rolls. The second disadvantage is the requirement that the thickness ["E" in FIG. 1] of the initial section (1) exceed the height [h' in FIG. 1] of the dogbone (2) and the flange height ["H" FIG. 1] of the finished beam. This disadvantage of universal beam rolling was not as critical when initial sections (1) were produced by ingot-fed blooming mills which could produce initial sections of the various dimensions required by the beam mill rolling program. However, widespread manufacture of initial sections by continuous casting has caused this second disadvantage to assume increased significance.

In its present state of technological development and operative earning capacity, continuous casting does not always allow casting a bloom of sufficient bulk for a blooming mill to be able to convert it into as many initial sections of variable dimensions as are required by the beam mill rolling program. Moreover, use of a blooming mill reduces the earning capacity otherwise available from continuous casting.

To remedy the above mentioned disadvantages of universal beam rolling, Soviet author's Certificate 174.160 issued Aug. 27, 1965 recommends rolling continuous cast slabs in a reversible universal stand to make the dogbones needed for producing beams with very high webs. This reference, however, does not disclose the procedure for applying said recommendation, nor does said recommendation eliminate the second disadvantage of the known universal beam rolling process. The thickness E of the slab would still have to be greater than or equal to the dogbone flange height h' and the finished beam section flange height height H.

German Patent Specification No. 744,683 issued Jan. 22, 1944 advocates cold universal rolling of a small-sized rectangular initial section for producing curtain rods or toy train rails. However, this reference also fails to explain the procedure and does not hint or suggest any means for eliminating the second disadvantage discussed above. Referring to FIGS. 1 and 5 of German Pat. No. 744,683, a comparison of the thickness of the initial section (FIG. 1) with that of the finished section flange height (FIG. 5) show that the initial section thickness exceeds the finished flange height. Therefore, the second disadvantage of the universal beam rolling process remains unresolved by the teaching of this reference.

French Patent Specification Nos. 2,346,063 and 2,464,759 suggest thrusting an initial section between vertical rollers or rolling it between horizontal rolls to produce a dogbone of flange height h' greater than the initial section thickness E. Though one of the objects of the French patents is similar to that of the present invention, the procedures set forth in them are entirely different.

DISCLOSURE OF THE INVENTION

One of the objects of the present invention is to reduce roller wear and tear while simultaneously increasing rolling speed by fully universal rolling of an initial section of rectangular cross section, thereby eliminating the "dogbone" stage. Another purpose is to reduce the number of initial sections of various dimensions required for the production of all of the sections in the beam mill range, while providing mainly for the top of the range, namely, beams having large web or flange heights, by using an initial section whose thickness and width are less than or equal to the web or flange heights of the finished beam section. The purpose of this is to make the continuous casting production of initial section profitable by diminishing the number of initial section of different sizes necessary to ensure a complete range for the mill production.

To achieve the stated purposes, this invention comprises a fully universal rolling process for H and I-beams and equipment for operating the process. The process of the invention is made of two parts. The first part is a universal rolling process practiced by means of at least one universal stand and one two-high stand for converting an initial section of rectangular or trapezoidal cross section into a rough beam, exclusively by means of open grooves. The second part is made of the known universal beam rolling to convert the rough beam formed in step one into a finished beam.

The first step of the process, according to the invention, comprises two principal phases:

(a) a first phase comprising a first series of passes, for recessing the portion of the initial section which will form the web, effected by means of the horizontal rolls of the universal stand;

(b) a second phase comprising another series of passes, for simultaneous reduction of the web and flanges, achieved by the horizontal rolls and the vertical rolls, respectively.

In the first phase, recessing of the web forming portion involves an overriding reduction of this portion to the detriment of the flange forming portions. Thus, according to one aspect of the invention, there is a rapid initial roughing down enabling the number of passes to be reduced. When the section to be formed is symmetrical, the pressure exerted by the vertical rolls during the recessing stage is often only indirect, serving to compensate for the cross sectional reduction of the portions which form the flanges, following transfer of metal from the flanges to the web and the elongation induced by traction of the wrought portion. If the section is asymmetrical, it is advisable during the recessing stage for one vertical roll to exert a certain direct complementary pressure from the heavier side of the section, so that the bar comes straight out from the housing properly aligned in the direction of rolling. The second vertical roll may continue to exert only an indirect pressure. The direct complementary pressure is required to ensure a sectional reduction of the heavier portion to establish equilibrium of the elongations thereby facilitating the rolling.

In the second phase, a simultaneous reduction of web and flanges is made. This time both vertical rolls exert direct reductive pressure on the sides of the rough beam in formation. When the ratio of the height of the flanges of the rough beam to the thickness of the initial section (1) exceeds or equals unity, the flange formation process is achieved by successive slotting and rolling by means of vertical rolls of various profiles.

Where the ratio of the width of the rough beam cavity to the thickness of each portion of the initial section that will form the flanges is greater than or equal to unity, one will favor the increase of the width of the web cavity by rolling spare metal provided in the rough beam web, with specifically shaped horizontal rolls. Rolling of the top portion of the flanges, satisfactory symmetrization of the symmetrical sections and/or the required value of each half-flange are obtained by rolling in open groove in the two-high stand which is normally paired with the universal stand. It is advantageous to locate the two-high stand either side by side or off center to the universal stand, rather than in line, so as to avoid their being subject or contributing to restraints due to the shape of the grooves or the sequences of the passes.

Further features and advantages of the present invention will be more fully apparent from the following description and annexed drawings of the presently preferred embodiments thereof.

DESCRIPTION OF THE DRAWINGS

In the drawings:

In FIG. 2, A denotes the width of the initial section portion that will form the flange thickness a;

(FIGS. 4B and 4C);

FIGS. 5A and 5B denote the profiles as adapted for slotting the flanges in accordance with one aspect of the invention. FIG. 5C shows the profile of the finishing vertical rolls as used in the known art;

BEST MODE FOR CARRYING OUT THE INVENTION

In the universal rolling process of the state of the art (FIG. 1), the cross-section of the dogbone (2) is generally homothetic with that of the finished beam section (3). It is generally understood in the state of the art that the thickness E of the initial section (1) is determining factor in obtaining a given flange height h' of the dogbone (2). In particular, it is necessary that E be greater than or equal to 1.5h' and that h' be greater than or equal to $H \times 1.1$.

Figure 1:
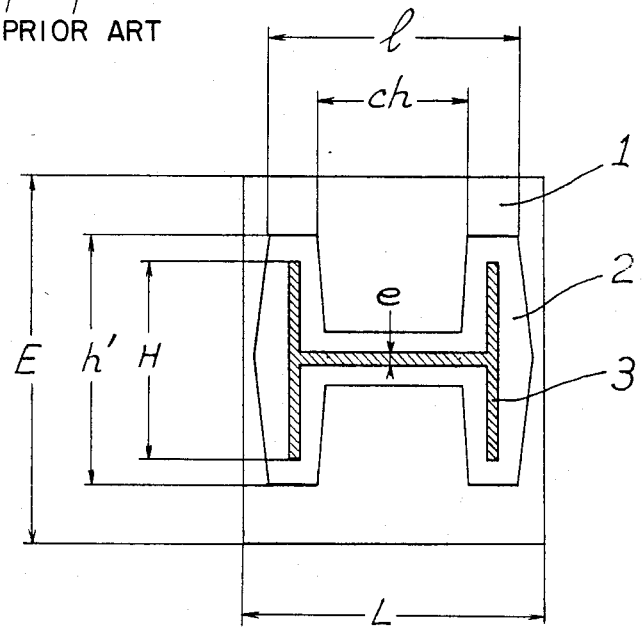
Fig. 1 PRIOR ART
FIG. 1 shows superimposed cross sections of an initial section (1) of thickness E and width L, a dogbone (2) of flange height h', and a finished beam (3) of flange height H, according to the known universal beam rolling process.
Figure 2:
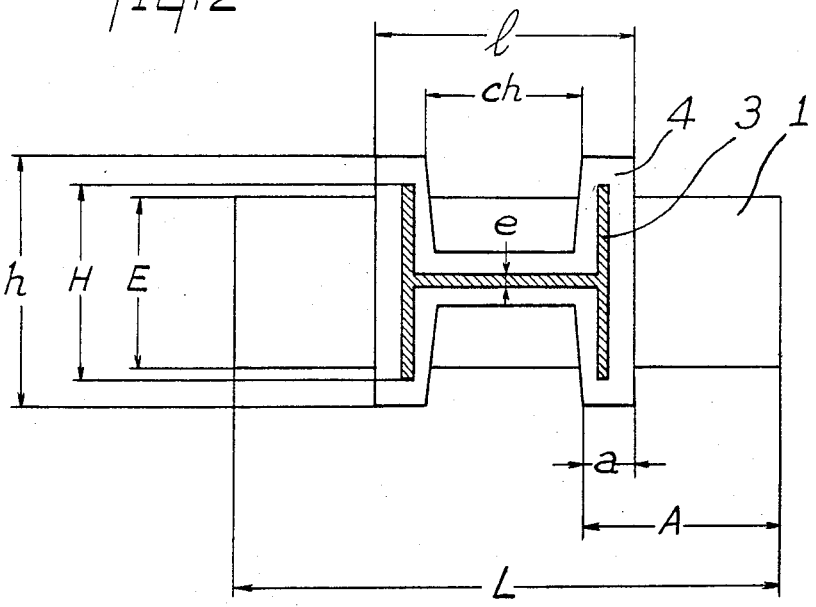
FIG. 2 shows the superimposed cross sections of an initial section (1) of thickness E and width L, of a symmetrical rough beam (4) (flange thickness a, flange height h, width L and cavity width ch), and of a finished beam (3) of flange height H, all as formed in accordance with the method of the present invention, the finished beam being of the same size as that shown in FIG. 1.

FIG. 2, drawn to the same scale as FIG. 1, clearly demonstrates one of the advantages of the novel process described herein. The thickness E of the initial section (1) is smaller than that required in the process of the prior art. It should also be noted that according to one aspect of the invention an appreciable widening of the flanges may be achieved as the flanges of the finished beam (3) is greater than the thickness E of the initial section (1). In the process according to the invention, the thickness E of the initial section (1) can, compared with the rough beam (4), be such that: $0.73h \leqq E \leqq 1.15h$, and, compared with the finished beam, be such that $0.80H \leqq E \leqq 1.2H$.

Figure 3A:
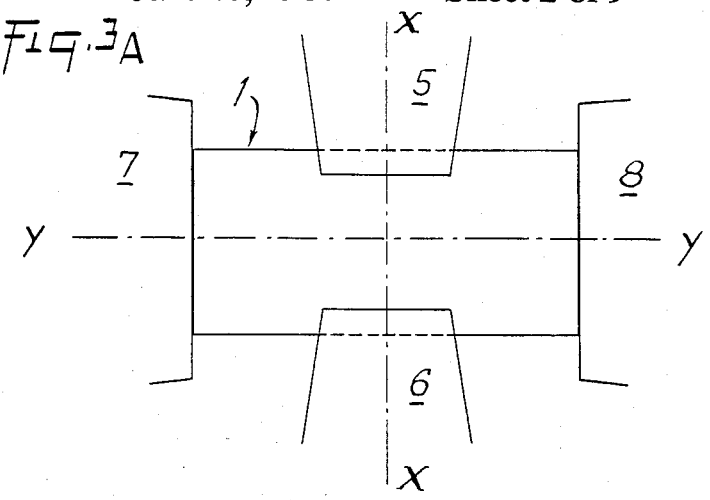
FIGS. 3A and 3B diagrammatically illustrate the two phases for forming a rough symmetrical beam according to the present invention.
Figure 3B:
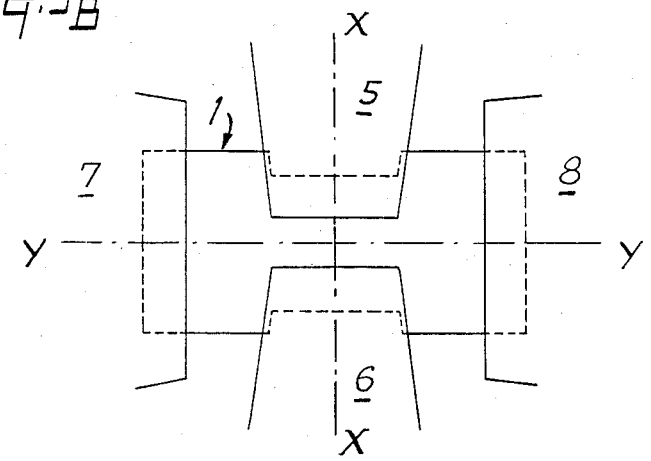

FIGS. 3A and 3B diagrammatically illustrate, for the case of a symmetrical section formed in accordance with the invention, the two forming phases of the rough beam. In the first phase, (FIG. 3A) the initial section (1), essentially of rectangular cross section (although it may be trapezoidal), passes between the horizontal rolls 5, 6 and the vertical rolls 7, 8 of a universal stand, adjusted such that (a) horizontal rolls 5, 6, during the several successive passes, move the initial section (1) along while substantially reducing (to a thickness ratio of ½ for example) the portion which eventually forms the web of the section (recessing period); and (b) vertical rolls 7, 8 are used only to center the initial section (1) in the vertical rolling plane through the line XX, merging with the vertical rolling plane of the section.

Vertical rolls 7 and 8 prevent the spread that can result from the recessing of the web and compensate for the loss of metal resulting from transfer of a portion earmarked for the flanges to the web and from elongation induced by traction. Such compensation is obtained by a reduction of 4 to 5% in the width of the portion of the initial section intended for forming the flanges. This diminution in the width of the rough beam serves to maintain, on the sides of the horizontal rolls and on the surfaces of the vertical rolls, a compression of the rolled metal skin sufficient to obviate a floating of the rough beam between the horizontal rolls and vertical rolls. The recessing of the web is deep and successive, effected in several passes. The outflow of metal is distributed evenly across the whole volume in the sphere of influence of the horizontal rolls and vertical rolls. An average rate of elongation is established in the rolled bar section on both sides of the center line XX, of the rolling operation. The result of this is that the direction of the bar as it issues from the rollers remains perfectly centered on the rolling center line XX.

In the second phase of the invention (FIG. 3B), reduction of web and flanges occurs simultaneously by action of the horizontal rolls 5, 6 and the vertical rolls 7, 8, respectively, while selecting the variation of ratio of the elongation rates at each pass for the web and flanges so as to promote or not promote the formation of the flanges, their widening or the reduction of their height.

Figure 4A:
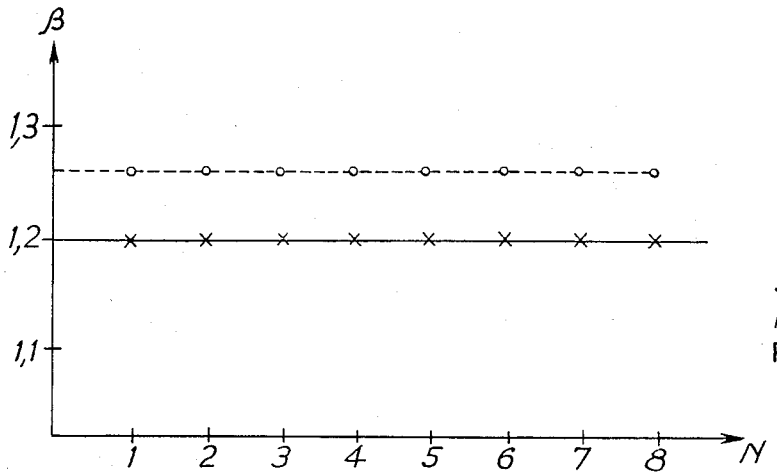
Fig. 4A PRIOR ART
FIGS. 4A–4C diagrammatically illustrate the elongation rates B of the web and flanges in terms of the number N and sequence of passes, firstly according to the known universal rolling method (FIG. 4A), and secondly according to two applications of the novel process described herein.
Figure 4B:
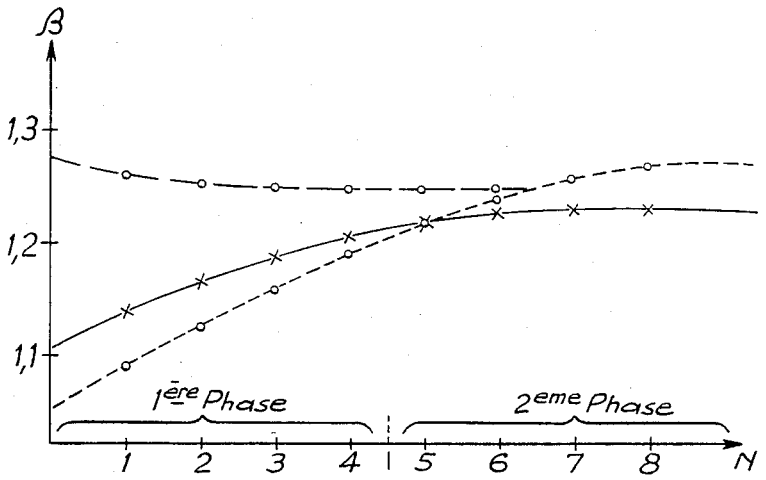

It is especially advantageous to use a rolling sequence differing from that used in the known universal rolling process. According to the known sequence, the rate of flange elongation at each pass is in constant ratio to the rate of web elongation with the ratio typically being 1.05:1. This is illustrated in FIG. 4A, where the unbroken line indicates the constant elongation rate (B) of the web, and the broken line the constant elognation rate (B) of the flanges, whatever the number (N) of passes. The sequence of the invention uses the principle of variable elongation rates, thereby taking advantage of the considerable thicknesses of the flanges and web during the early passes, which obviate lacerations or corrugation due to differences in elongation. In accordance with the invention, there is a greater freedom of choice of variations of elongation rates for the web and flanges during the intial passes of the two phases, while maintaining the rate of flange elongation between 0.80 and 1.25 of the rate of web elongation. In the final passes the ratio of the flange/web elongation rates returns gradually to about 1.05. The variation selected for the web elongation rate provides the information necessary for establishing the flange elongation rates within the above-cited limits. FIG. 4B illustrates this principle: the unbroken curve indicates the variations selected for elongation rate (B) of the web in terms of the number (N) of passes; the broken curves demonstrate the limits within which the flange elongation rate must then be kept. The different possible selections for the ratio of web/flange elongation rates, starting with an initial section of given cross section, expedite obtaining different rough beams and, consequently, different sections of finished beams. When sections of relatively large flange width are desired, (bearing in mind that h/E is greater than or equal to unity) the second phase of the inventive process uses the method of forming by successive slotting and rolling of the flanges through the operation of vertical rolls of various profiles according to a special sequence.

Figure 5A:
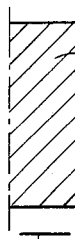
FIGS. 5A–5C illustrate half-sections of three types of open section vertical rolls used to practice the invention.
Figure 5B:
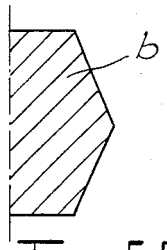
Figure 5C:
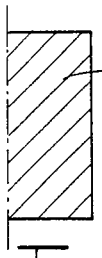
Figure 6A:
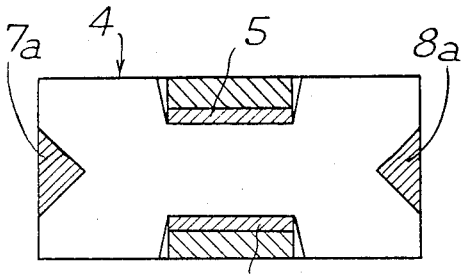
FIGS. 6A–6F illustrate the successive reductions effected by the second phase of the inventive process, with vertical rolls of various profiles represented as in FIGS. 5A and 5B.
Figure 6D:
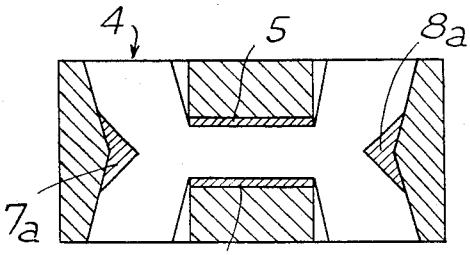
Figure 6B:
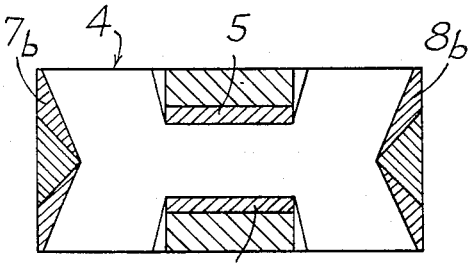
Figure 6E:
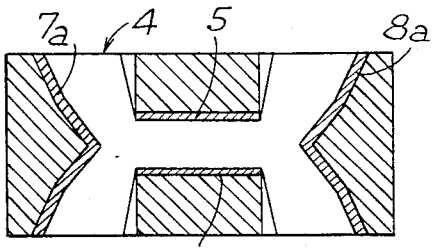
Figure 6C:
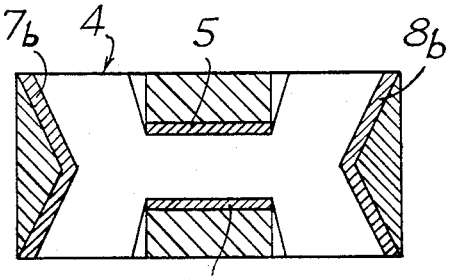
Figure 6F:
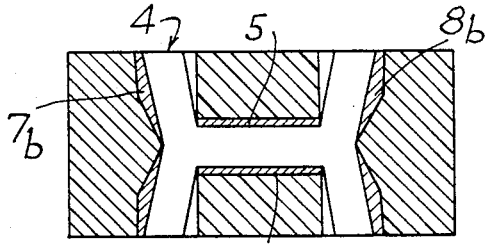
Figure 7A:
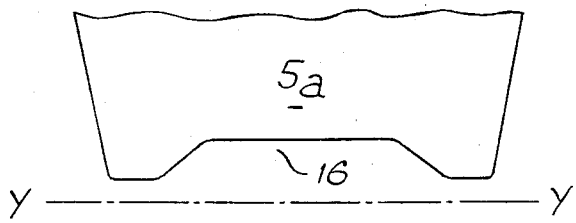
FIGS. 7A–7D represent the universal-stand horizontal-roll shapes for forming the metal reserves on the web of the rough beam (4) (only the shape of the upper roll is indicated, as that of the lower roll is identical)
Figure 7B:
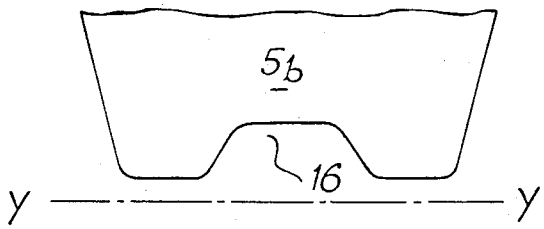
Figure 7C:
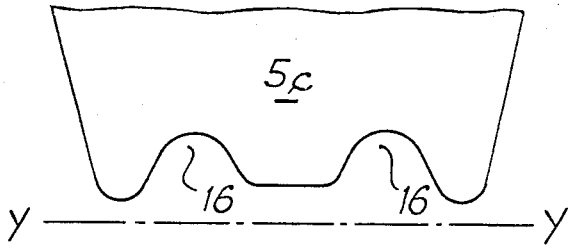
Figure 7D:
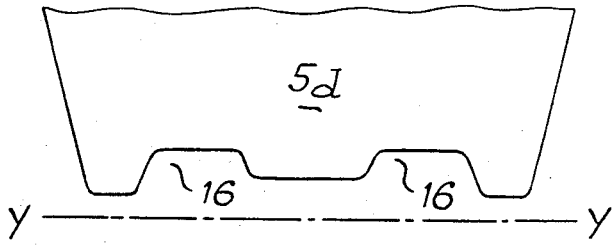

Thus, according to one aspect of the invention, the three vertical open-type rolls of profiles a, b, c shown in half-sections in FIGS. 5A, 5B, 5C can be advantageously used according to the sequence illustrated in FIGS. 6A–6F, where the hatchings sloping up from left to right represent the reductions effected on the pass under consideration, and the hatchings sloping down from left to right reflect the reductions from preceding passes. The passes of FIGS. 6A, 6D, 6E are accomplished by the vertical roll of profile a in FIG. 5A, whose sharp profile is clearly adapted for deep slotting. The passes of FIGS. 6B, 6C, 6F are effected with the vertical roll of section b in FIG. 5B. These passes can then be followed by a pass using the vertical roll of profile c in FIG. 5C in the finishing stand, the horizontal rolls of which have sides of equal inclination for restoring a constant thickness to the flanges. These variously profiled rolls can be placed in several universal stands one after the other, or else in a single universal stand equipped with special vertical roll chocks containing several vertical rolls with different profiles. In the latter instance, the rolls of the profile suitable to the pass going through can be placed in rolling position by shifting the rolls in a vertical plane or by rotating a turret.

Figure 4C:
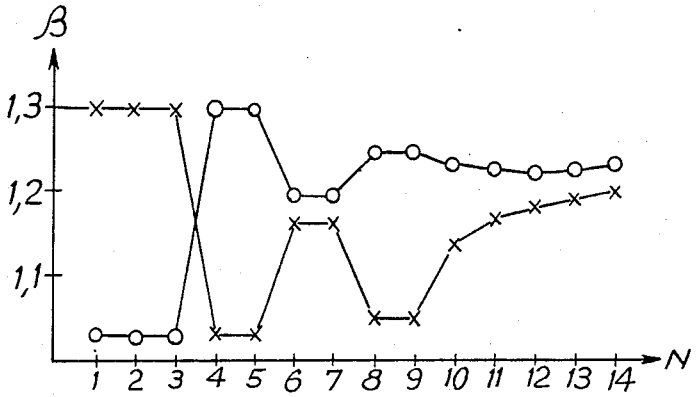
Figure 8A:
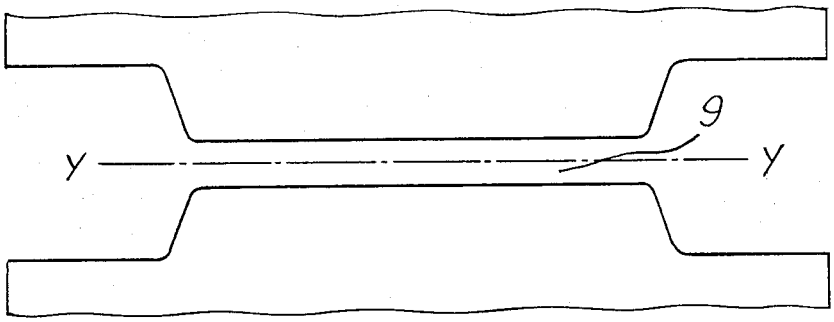
FIGS. 8A–8B show the flat-bottom groove used for increasing the width of the cavity of the rough beam having metal reserves formed by the rolls of FIGS. 7A and 7D.
Figure 8B:
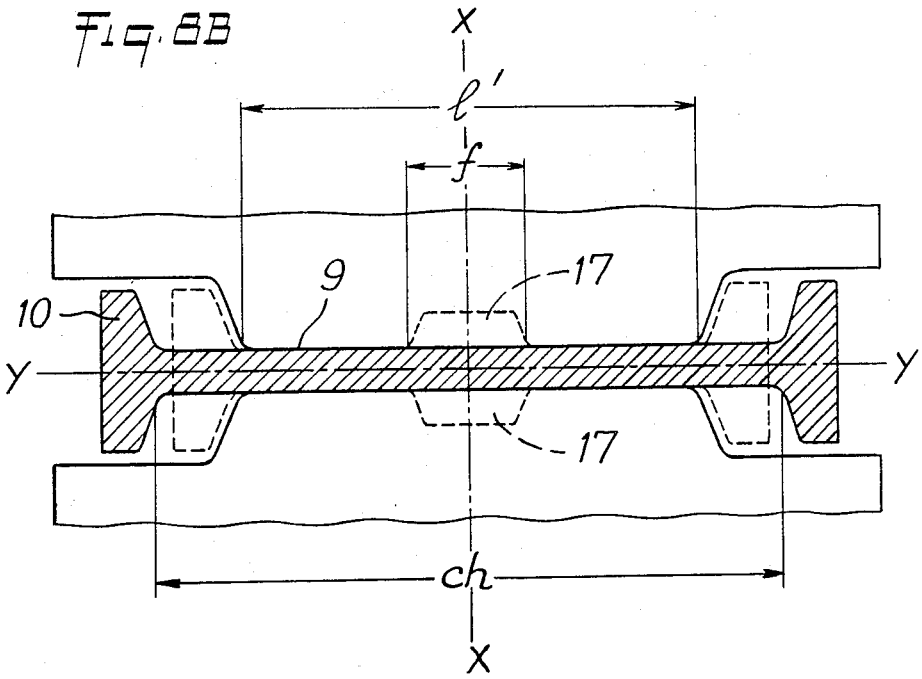

As discussed above, FIG. 4B shows elongation rates in the sequence of formation of the rough beam without changing the profile of the vertical rolls 7 and 8. FIG. 4C shows a similar diagram for a formation sequence for a rough beam with a change of profile of the vertical rolls 7 and 8, in accordance with a sequence of profiles such as, for example: a.a.a./b.b./a.a./b.b.b.b.b.b./c. in which the symbol/indicates a change of vertical rolls after passes Nos. 3, 5, 7 and 13. When the width (ch) of the cavity of the sections is large (ch greater than or equal to 2A), the horizontal rolls 5*a*, 5*b*, 5*c* or 5*d* (FIGS. 7A to 7D) will be used according to the circumstances for the first recessing phase of the web and the simultaneous second reduction phase of the web and flanges, said rolls being profiled so as to have one or more grooves (16) for the purpose of forming one or more reserves of metal or longitudinal cores, 17, on the web of the rolled section. See FIG. 8B.

Figure 12:
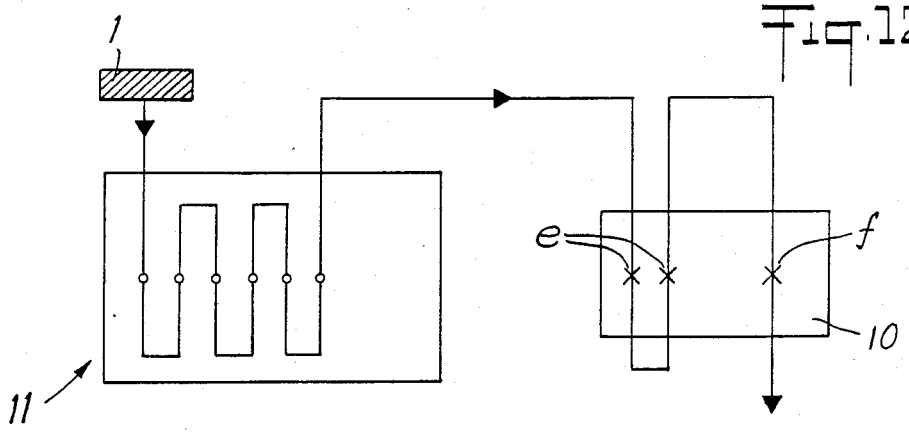
FIG. 12 shows a further variation of pass sequence in the roughing group of stands of FIG. 9B, for obtaining rough beams having a larger widened cavity.

The recessing of the web takes place simultaneously with the formation of a special sectioned web, comprising one or more cores 17 (FIG. 8B) that form a kind of metal reserves on each of the faces of the web which are then rolled in a two-high stand provided with a flat-bottomed sideless groove 9 (FIG. 8A) in a series of passes preceding the final passage in the open groove that forms the desired rough beam. For example, in the sequence of passes shown in FIG. 12, the second pass is made in a groove g of the type shown in FIG. 8A.

The metal cores 17, being the only portions of the rough beam that are reduced in this series of passes, cannot be elongated naturally since they are restrained by the solid unwrought lateral portions that are to form the flanges. These latter cores are then slightly reduced by the effect of the web-imposed traction. The rough beam cavity width is strongly widened. The lateral portions being free and not restrained by the sides of the groove move further and further apart the greater the bulk of the core(s) 17 in relation to the final bulk of the web portion.

Formulation of the cores is necessary, starting with a groove having a flat portion of definite length (1') (groove 9 in FIGS. 8A and 8B), to make it possible to roll the overthickness of the cores in relation to the thickness of the web without distorting the webs when, after spread has been effected, the rough beam 10 (FIG. 8B) has a cavity width ch greater than the portion 1' of the groove. At the limit, ch−1' can equal 1'−f, f being the width of the core(s) composing the reserve of metal in the rough beam.

By using horizontal rolls 5*a* to 5*d* in FIG. 7 of equal width but whose core sectioning varies, allows, starting from the same initial section (1) (of height E and length L) (E×L), rolling of the rough beams corresponding to finished beam sections of different cavity widths ch, thus reducing the width L of the initial section (1) required for the widest finished beam sections.

It is further evident that development of the flanges during formation is largely facilitated since, if the relation of total reductions (web portion over flange portion) decreases, the transfer of metal from the flange portions to the web portion decreases proportionally, as does the induced elongation.

Rough beam rolling in an open groove in conjunction with slotting of the flanges on universal stands is effected on a two-high edging stand in accordance with a suitable alternation sequence of the active passes in both types of stands, after the web cavity has been widened by rolling the web core when needed. For example, refer to the series of passes illustrated in FIGS. 10, 11 and 12.

The two-high edging stand reduces the rough beam prepared on the universal stand at the value sought for the web thickness and flange height for the final rolling in accordance with the known universal rolling process on a universal rolling mill. This reduction is effected in a open groove. This ensures: satisfactory forging of the top portion of the flanges by direct reduction, satisfactory symmetry of the shape along the horizontal plane by simultaneous rolling of flanges and web in a groove having the required depth of the half-flanges (the total reduction is considerable and may be as much as 20%) flange height the rough beam adapted to the profile of the finished beam; web height suited to the finished beam section; web thickness correct for the ratio e/a.

Furthermore, by placing on this stand several grooves having equal cavity but different flange heights coresponding to the derived finished beam section, rough beams of the complete series of the same type of finished beam section (U.S. series, for example) are obtainable. Also, by placing grooves of different profiles on this same stand, the stock of required rolls is reduced.

Figures 9A, 9B, 9C, 9D:
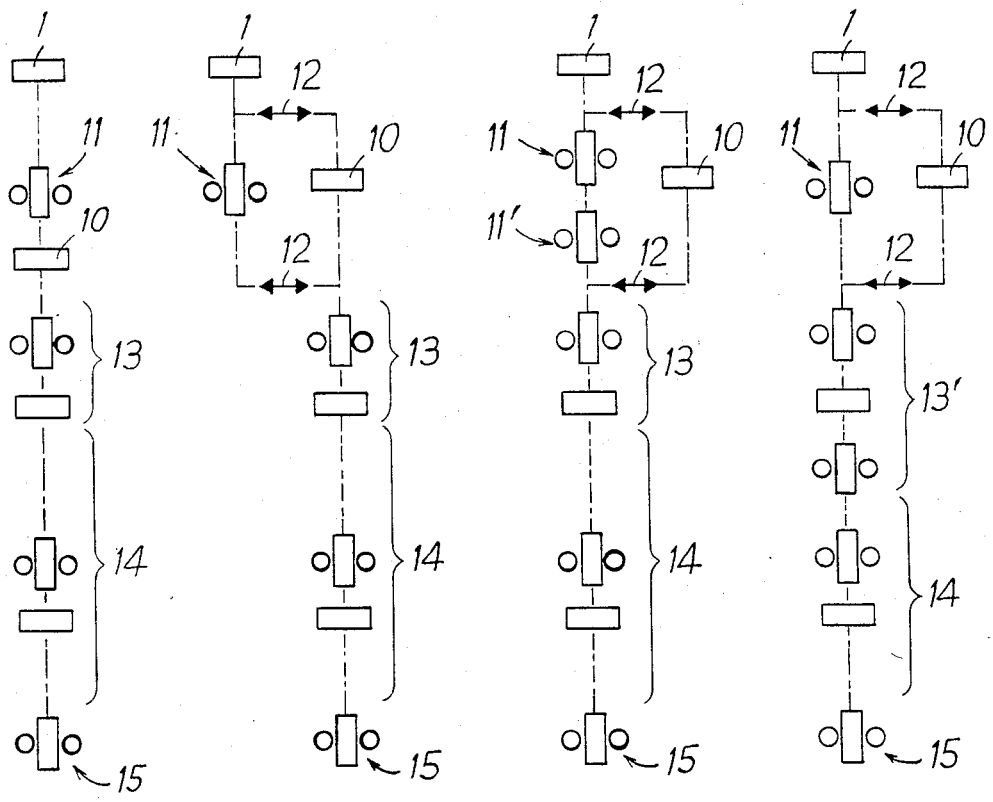
FIGS. 9A–9D illustrate implementations on different mills of four different ways to apply the fully universal rolling process of the invention, shown from the initial section to the finished beam section.

By providing a mill such as the one illustrated in FIG. 9A, it is clear that the two-high stand (10) located on the same center line as the universal stand (11) can normally have only a single open groove, unless it is "shiftable," for example, and it can, therefore have only one specifically active passage during the formation sequence. For that reason, and as can be ascertained on the three rolling mills illustrated in FIGS. 9B, 9C, 9D, it is preferable to locate the two-high stand and the universal stand(s) side by side (FIGS. 9B, 9D) or at least on two offset center lines (FIG. 9C).

FIG. 9B diagrammatically illustrates an initial section (1) obtained, for example by continuous casting, at the feeding end of the roughing group according to the invention composed of the universal stand (11) and the two-high stand (10) located side by side. The arrows (12) symbolize the passages of the bar between stands (11) and (10) during the second phase of the process according to the invention.

Figure 10:
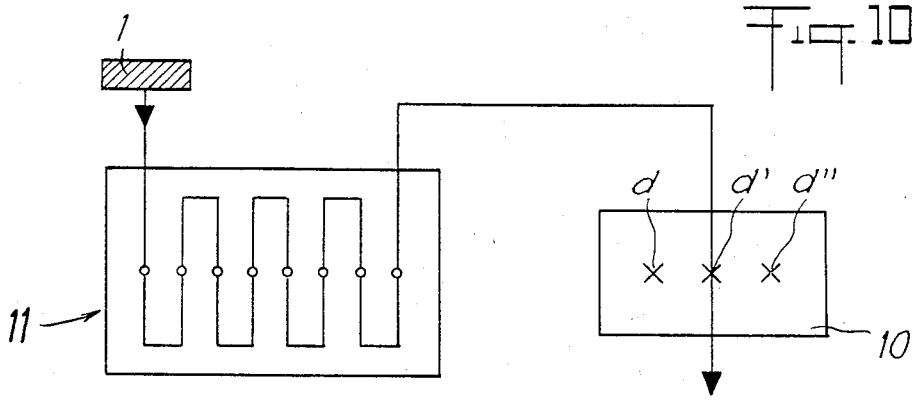
FIG. 10 diagrammatically illustrates a sequence of passes made in the roughing group of stands of FIG. 9B.

In this arrangement, the rolling sequence, as illustrated diagrammatically in FIG. 10, may consist of eight passages on the universal stand (11) and, after transfer upstream, a final passage in the intermediate groove (d') of the two-high stand (10) to ensure the correct final section of the rough beam.

Figure 11:
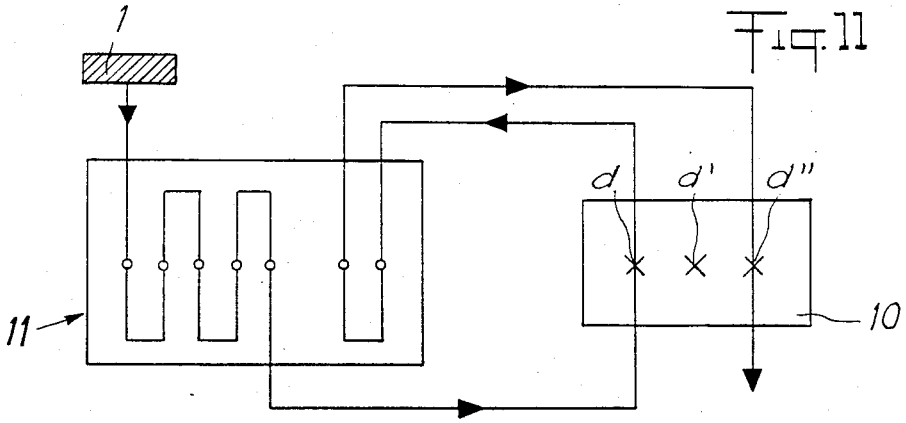
FIG. 11 shows another possible sequence of passes made in the roughing group of stands of FIG. 9B, for obtaining rough beams of lesser flange height.

In the case of sections derived from different flange heights, the sequence could, as illustrated in FIG. 11, be of five passages in the universal stand (11), one downstream transfer to the two-high stand (10) for one passage in groove (d), one upstream transfer for one round trip in the universal stand (11), and one upstream transfer for the final passage in groove d" of the two-high stand (λ0).

In the case of sections with widening of web cavity (FIG. 12), the spreading passes will be made in groove e just prior to the final passage in groove f of the desired rough beam.

With reference to FIG. 9B, according to the customary practice, once a suitable rough beam has been obtained, rolling proceeds in accordance with the universal process of the state of the art in the universal and edging stands, according to the roughing (13), intermediate (14) and finishing (15) stages until the finished beam section is obtained.

The diagram of FIG. 9C differs from FIG. 9B in that two universal stands (11) and (11') in tandem are used with an off center two-high stand (10) for implementing forming in accordance with the invention.

The diagram of FIG. 9D is distinguished from that of FIG. 9B in that the rough beam formed in accordance with the invention is roughed in a tandem set 13'.

The process described above for symmetrical sections is also suitable for formation of asymmetric sections of beams by thickening of one flange in relation to the other, or by decreasing or increasing one of them in relation to the other, or by a combination of these two possibilities.

Figure 13:
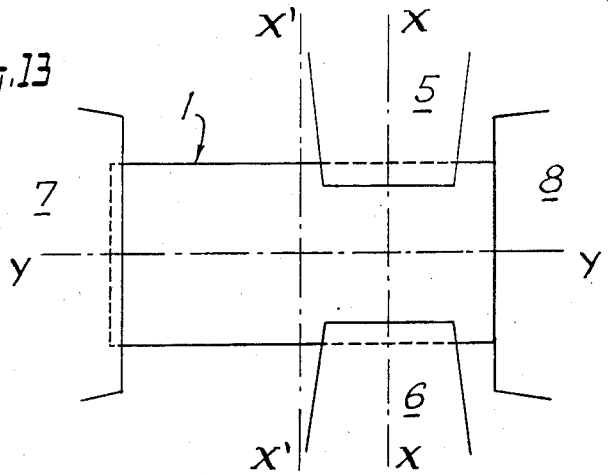
FIG. 13 illustrates the first phase of the invention for the formation of an asymmetrical rough beam.

For asymmetric sections it is, however, advisable to keep several phenomena in mind. During asymmetric recessing as illustrated in FIG. 13, the slotting centerline XX no longer coincides with the axis of symmetry X'X' of the initial section (1). The flow of the metal between the horizontal rolls and vertical rolls is not the same as in the recessing of symmetrical sections because the portions of the section on either side of the slotting center line are no longer similar. The average rate of elongation is no longer established equally on both sides of the centerline XX. The flow of the metal that occurs in a direction diverging more or less from the rolling axis in accordance with the margin of the bulks located on either side of the slotting axis is unequal. The direction of delivery of the bar diverges from the rolling plane. The bar is said to "weave."

To reestablish coincidence of the direction of issue and the rolling axis, a complementary elongation must be instigated by a supplementary reduction in the portion of the initially strongest section, as shown in FIG. 13 where vertical roll (7) exerts a certain direct pressure intended to restore equilibrium, while the vertical roll (8) does not exert any direct pressure.

To apply the required complementary reductions in practice, they must be incorporated under the conditions of equilibrium of the system of rolling forces by selective action on the various parameters that govern them. The most useful parameters to be considered are the horizontal roll diameter, the vertical roll diameter and especially their ratio, rate of pressure and reduction, and flow coefficient. In short, the conditions of stability of the section between the rolls must be observed.

During the second phase of the process, it is advisable to bring about equilibrium of the elongations on each side of the vertical rolling plane XX. The lateral strains to which the rough beam is subjected by action of the vertical rolls must be equal, or the lateral thrust resulting from their difference—which may well be minimized by adjusting the aforementioned parameters—should be transmitted and absorbed. Thus, as previously stated, in the process according to the invention, in the initial passes the recessing of the portion that forms the web section is facilitated at the expense of the portions which form the flange sections when their thickenesses are more substantial, the purpose being to minimize the lateral strains while simultaneously endeavoring to balance said strains and to increase the lateral reaction of the horizontal rollers in terms of the control height of their sides, which increases at each pass. The initial section (1) must be perfectly centered in the vertical rolling plane.

In the process according to the invention, the dimensions E×L of the initial section (1) for obtaining a rough beam suitable for the finished beam section depend on the method selected: (a) method of fully universal roughing; (b) method of fully universal roughing with flange slotting; (c) method of fully universal roughing with widening of the web cavity; (d) combined method embodying the above three methods.

In all these methods, the ratio λ, which is the quotient of the ratios of thickness reduction of the portion earmarked for the web on the one hand:

$$\lambda\text{web}=E/e$$

and the portions earmarked for the flanges on the other.

$$\lambda\text{flange}=A/a$$

or $$\lambda = \frac{\lambda\ \text{web}}{\lambda\ \text{flange}} = \frac{\frac{E}{e}}{\frac{A}{a}}$$

is retained as a standard of selection and computation.

This ratio λ allows definition of a coefficient 5K for sections having the same cavity width ch, such coefficient representing the variation of the value of the height h of the rough beam flanges in relation to the thickness E of the initial section (1):

$$K=h/E$$

Figure 14:
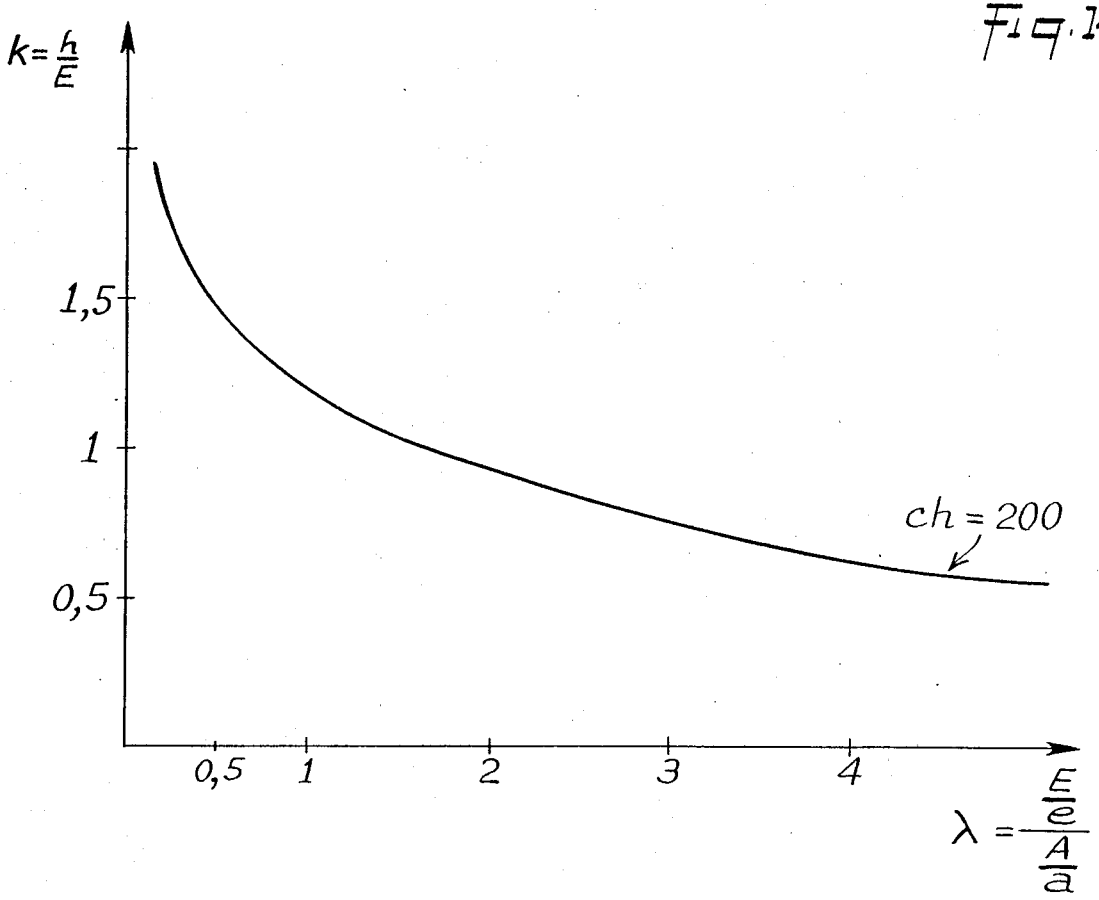
FIG. 14 illustrates the K curve (h/E ratio) in terms of $\lambda$ (ratio Ea/eA).

Use of the various methods leads to the establishment for each of a curve for values of K, $K_1$, $K_2$, etc. (FIG. 14). Thus it can be seen that:

$$E=h/k$$

$$L=2A+ch$$

When the process is in use, the horizontal rolls, which are driven, must always carry the product along while exerting a certain reduction of the web.

For rolling to be possible, the following limits of application must generally be respected:

1. web reduction: $2 \leqq E/e \leqq 6$
2. flange reduction: $1.5 \leqq A/a \leqq 4$
3. initial section reduction: $0.7 \leqq E/A \leqq 1.5$
4. values of: $0.5 \leqq \lambda \leqq 4.00$

What is claimed is:

1. A process for forming a rough beam type metal section having a web forming portion and flange forming portions comprising the use of a universal stand and a two-high stand, said universal stand having two horizontal rolls and two vertical rolls, by passing an initial section of rectangular or trapezoidal cross section through a roll gap formed by said rolls of said universal stand, said process comprising the steps of:

(a) recessing the web forming portion in a first series of universal passes through said roll gap by means of the horizontal rolls exerting direct pressure on the central portion of the initial section while the vertical rolls exert only sufficient pressure on the initial section to resist spread of the metal in the horizontal direction caused by recessing of the web and to maintain the initial section in the direction of the centerline of rolling upon discharge from the universal stand for achieving, during this step, greater reduction of the web forming portion than the flange forming portion; and (b) thereafter simultaneously reducing the web and flange forming portions in succeeding passes through said roll gap by means of the horizontal rolls and vertical rolls of the universal stand exerting direct pressure on the web forming portion and flange forming portions, respectively.

2. The process according to claim 1, further comprising during step (b), the step of rolling said rough beam in formation in open grooves of said two-high stand according to a sequence of selected alternation.

3. The process according to claim 2, further comprising arranging the universal stand and the two-high stand in side by side relation.

4. The process according to claim 2 further comprising the step of arranging the universal stand and the two-high stand such that their respective center lines are off-set.

5. The process according to claim 3 further comprising the step of arranging the universal stand and the two-high stand such that their respective center lines are off-set.

6. The process according to claim 1, further comprising during step (b) the step of forming said flanges by successive slotting and rolling by vertical rolls having at least two different profiles.

7. The process according to claim 1, further comprising during step (b) the step of forming said flanges by successive slotting and rolling by vertical rolls having at least two different profiles.

8. The process according to claim 1, and wherein the rough beam being formed is symmetrical, and wherein during recessing of the web forming portion, virtually no direct pressure is exerted on the portions that are to form the flanges.

9. The process according to claim 7, and wherein the rough beam being formed is symmetrical, and wherein during recessing of the web forming portion, virtually no direct pressure is exerted on the portions that are to form the flanges.

10. The process according to claim 1, for the formation of an asymmetrical rough beam, wherein during recessing of the web forming portion, direct pressure on the portions that are to form the flanges is exerted only from the one side of the bulkier initial section, for maintaining the bar being discharged in the direction of the centerline of rolling.

11. The process according to claim 7, for the formation of an asymmetrical rough beam, wherein during recessing of the web forming portion, direct pressure on the portions that are to form the flanges is exerted only from the one side of the bulkier initial section, for maintaining the bar being discharged in the direction of the centerline of rolling.

12. The process according to claim 1, and further comprising regulating parametric values affecting rolling forces, including regulating at least vertical roll diameters, whereby conditions of stability of the section being rolled are maintained.

13. The process according to claim 11, and further comprising regulating parametric values affecting rolling forces, including regulating at least vertical roll diameters, whereby conditions of stability of the section being rolled are maintained.

14. The process according to claim 1, further comprising the steps of forming at least one metal core in the portion that is to form the web of the rough beam, said at least one metal core being formed by means of horizontal rolls of the universal stand having at least one groove to form said at least one core; and reducing said at least one core by a flat-bottomed sideless open groove of a two-high stand for widening the web cavity.

15. The process according to claim 13, further comprising the steps of forming one or more metal cores in the portion that is to form the web of the rough beam, said at least one metal core being formed by means of horizontal rolls of the universal stand having at least one groove to form said at least one core; and reducing said at least one core by a flat-bottomed sideless open groove of a two-high stand for widening the web cavity.

16. The process according to claim 1, wherein said web and flanges are elongated during steps (a) and (b), and further comprising varying said elongations during steps (a) and (b).

17. The process according to claim 15, wherein said web and flanges are elongated during steps (a) and (b), and further comprising varying said elongations during steps (a) and (b).

* * * * *

UNITED STATES PATENT AND TRADEMARK OFFICE

CERTIFICATE OF CORRECTION

PATENT NO. : 4,637,241

DATED : January 20, 1987

INVENTOR(S) : Jacques M. Michaux

It is certified that error appears in the above—identified patent and that said Letters Patent is hereby corrected as shown below:

Col. 1, line 49: "author's" should read --Author's--.
Col. 1, line 50: "174.160" should read --174,160--.

Col. 4, line 47: "flanges" should read --flange height--.
Col. 12, line 7: "one or more metal cores" should read --at least one metal core--.

Signed and Sealed this

Third Day of May, 1988

*Attest:*

*Attesting Officer*

DONALD J. QUIGG

*Commissioner of Patents and Trademarks*